United States Patent [19]

Nishio

[11] 4,354,112

[45] Oct. 12, 1982

[54] X-RAY CINE RADIOGRAPHY APPARATUS

[75] Inventor: Kosaku Nishio, Otawara, Japan

[73] Assignee: Tokyo Shibaura Denki Kabushiki Kaisha, Japan

[21] Appl. No.: 211,439

[22] Filed: Nov. 28, 1980

[51] Int. Cl.[3] ..... H05G 1/30

[52] U.S. Cl. ..... 378/99; 378/111

[58] Field of Search ..... 250/409, 408

[56] References Cited

U.S. PATENT DOCUMENTS 3,783,286 1/1974 Kremer ..... 250/409

*Primary Examiner*—Alfred E. Smith
*Assistant Examiner*—T. N. Grigsby
*Attorney, Agent, or Firm*—Finnegan, Henderson, Farabow, Garrett & Dunner

[57] ABSTRACT

An X-ray cine radiography apparatus comprising: an X-ray tube for radiating X-rays toward an object under examination; an image intensifier for converting the X-rays transmitted through the object into a visual image; a cine camera for picking up the visual image; a photomultiplier for detecting a brightness of the visual image to produce an electric signal; a first potentiometer for setting an upper limit tube voltage of said X-ray tube; a second potentiometer for detecting a signal corresponding to an actual tube voltage of said X-ray tube; a comparator for comparing the output signal of said second potentiometer with that of said first potentiometer and for producing an enabling signal when the former recited output signal exceeds the latter recited output signal; means for controlling quantity of light of the visual image picked up by said cine camera in accordance with the enabling signal of said comparator; and means for adjusting the actual tube voltage in response to the output signal of said controlling means and the electric signal of said photomultiplier.

3 Claims, 13 Drawing Figures

X-RAY CINE RADIOGRAPHY APPARATUS

BACKGROUND OF THE INVENTION

The present invention relates to an X-ray radiography apparatus and, more particularly, to an X-ray cine radiography apparatus.

The X-ray cine radiography uses an image intensifier for converting an X-ray transmitted through an object into a visual image. For obtaining a radiograph with a good contrast, it is essential to take a radiograph at the lowest possible tube voltage, for example, 50 to 70 KV, in order to satisfy a sensitivity characteristic of the intensifier per se, i.e. an energy absorption characteristic of the fluorescent material, for example, cesium iodide ($C_sI$), on the input side of the intensifier, and an X-ray absorption characteristic of the contrast media. In order to take a cine radiograph with the smallest possible noise arising from a non-uniform distribution of fluorescent particles of the intensifier, it is also considered that a dosage of X-ray onto the intensifier may exceed a usual predetermined one per inch, for example, 15 $\mu$R/frame in 9 inch mode. Thus, the radiography at the low tube voltage but of large mAS (the product of a tube current mA and an X-ray dosing time S) is required for a high quality cine radiograph.

The X-ray dosing time S is determined by the number of frames per second and also depends on a dynamic image resolution of the object. For example, a high precise detection of motion in a heart or a blood-vessel may be obtained at several frames per second so that it results in shortening of the dosing time. Since an excessive long dosing time reduces the dynamic image resolution of the object, this fact also restrains the elongation of the dosing time. Thus, in case where the high precision detection of the motion of the object to be radiographed and or the improvement of the dynamic image resolution is desired, the dosing time is preferably short, usually 2 to 5 m sec. For this reason, there is a limit in increasing the mAS value.

In a coronary artery radiography by the X-ray cine radiography apparatus, the X-ray is projected into the object in the frontal or lateral direction for taking a frontal or lateral mode image. This type of radiography apparatus has recently employed an axis-vertical (azimuth) projection which is a projection orthogonal to the axis of a body and an axis-oblique (elevation) projection which is a projection oblique to the body axis in which both the projections are respectively undertaken toward those frontal and lateral directions. In radiographing by the frontal projection, for example, it may be necessary to take successively a plurality of radiographs. Firstly, a positioning is set up in a direction which is orthogonal to the body axis and pointed from the asterior to posterier portion of the human body, as shown in FIG. 1A. A first image (frontal mode image) is radiographed with the positioning, as shown in FIG. 1B. Secondly, a positioning is set up in a direction which is rotated about the axis of the human body by 30° from the direction shown in FIG. 1A, as shown in 2A. With the second positioning, a second image (30° right anterior oblique mode image) is radiographed, as shown in FIG. 2B. A third image (30° right anterior oblique and 30° caudal mode image) is radiographed with a third positioning, as shown in FIG. 3A, set up in a direction which is lowered by 30° from the direction shown in FIG. 2A, and is illustrated in FIG. 3B.

Also in the radiography by the lateral projection, a first positioning, as shown in FIG. 4A, is established in a direction which is clockwise rotated about the axis of the body by 90° from the direction of FIG. 1A. With the first positioning, a first image (lateral mode image) is taken, as shown in FIG. 4B. Then, a second positioning, as shown in FIG. 5A, is established in a direction which is clockwise rotated about the axis of the body by 60° from the direction of FIG. 1A and with the second positioning, a second image (60° lateral anterior oblique mode image) is radiographed, as shown in FIG. 5B. Finally, a third positioning, as shown in FIG. 6A, is selected in a direction which is raised by 30° from the direction in FIG. 5A and with the third positioning, a third image (60° lateral anterior oblique and 30° cranial mode image) is radiographed, as shown in FIG. 6B.

The dosage of X-rays in the radiography, as mentioned above, which requires a plurality of the positionings including the oblique directional projections, is two to three times as large as that in the conventional radiography by the single frontal or lateral projection.

The X-ray dosage necessary for the multi-positioning radiography is unattainable even if the large-capacity X-ray tube currently available is used, which is preferably operated at low voltage in the X-ray cine radiograph apparatus. This impells us to use the apparatus at high X-ray tube voltage. For this reason, the conventional cine radiograph apparatus provides a cine radiograph with poor contrast.

As described above, the conventional X-ray cine radiograph apparatus has a limit in increasing the tube current X-ray dosage product mAS and is unsuitable for the appliance of a large dosage of X-rays.

SUMMARY OF THE INVENTION

Accordingly, an object of the present invention is to provide an X-ray cine radiography apparatus which can provide a cine radiograph with a high contrast image as low tube voltage.

According to the invention, there is provided an X-ray cine radiography apparatus comprising:

an X-ray tube for radiating X-rays toward an object under examination;

an image intensifier for converting the X-rays transmitted through the object into a visual image;

a cine camera for picking up the visual image;

a photomultiplier for detecting a brightness of the visual image to produce an electric signal;

a first potentiometer for setting an upper limit tube voltage of said X-ray tube;

a second potentiometer for detecting a signal corresponding to an actual tube voltage of said X-ray tube;

a comparator for comparing the output signal of said second potentiometer with that of said first potentiometer and for producing an enabling signal when the former recited output signal exceeds the latter recited output signal;

circuit for controlling quantity of light of the visual image picked up by said cine camera in accordance with the enabling signal of said comparator; and means for adjusting the actual tube voltage in response to the output signal of said controlling circuit and the electric signal of said photomultiplier.

The invention will better be understood when reading the following description in conjunction with the accompanying drawings; in which:

DETAILED DESCRIPTION OF THE PREFERRED EMBODIMENT

Figure 1A:
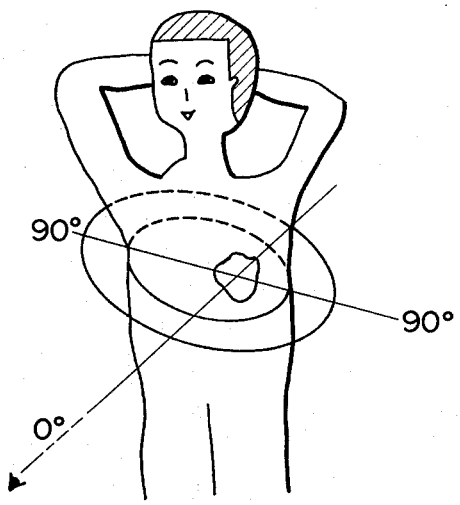
FIG. 1A diagramatically illustrates a positioning when an object is radiographed in a direction which is normal to the axis of the body and pointed from the anterior to posterior part of the body.
Figure 1B:
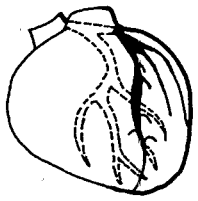
FIG. 1B illustrates an image (frontal mode image) of the object radiographed with the positioning of FIG. 1A.
Figure 2A:
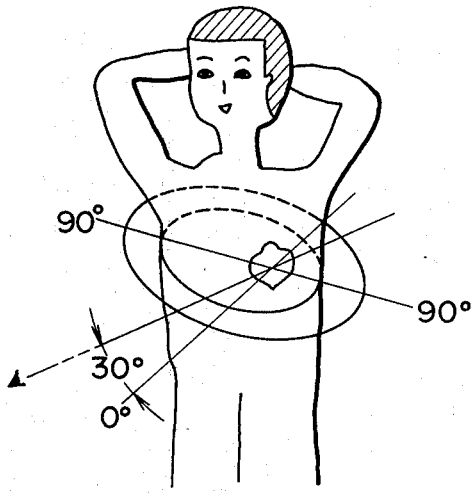
FIG. 2A is a diagram for illustrating a positioning when the object is radiographed in a direction which is rotated about the body axis by 30° from the direction of FIG. 1A.
Figure 2B:
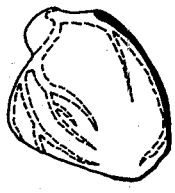
FIG. 2B illustrates an image (30° right anterior oblique mode image) radiographed with the positioning of FIG. 2A.
Figure 3A:
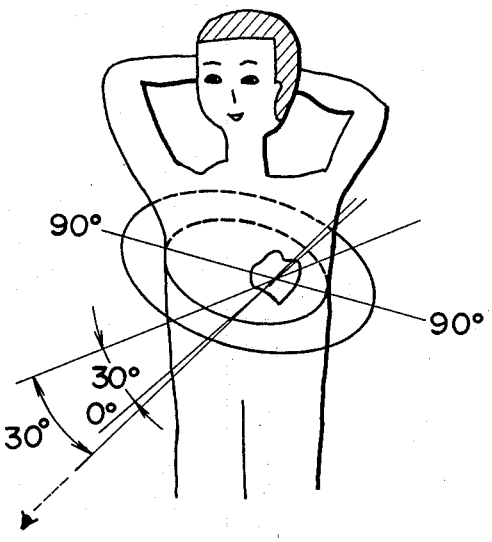
FIG. 3A is a diagram of a positioning when the object is radiographed in a direction which is lowered from the direction shown in FIG. 2A by 30°.
Figure 3B:
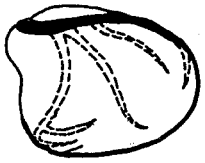
FIG. 3B shows an image (30° right anterior oblique and 30° caudal mode image) radiographed with the positioning shown in FIG. 3A.
Figure 4A:
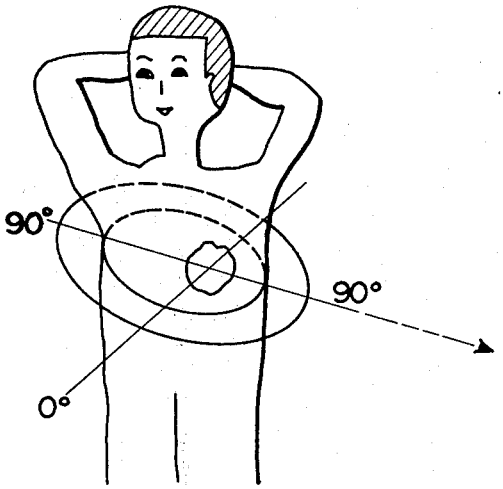
FIG. 4A shows a positioning when the object is radiographed in a direction which is rotated about the body axis by 90° from the direction shown in FIG. 1A and pointed from the left to right side of the body.
Figure 4B:
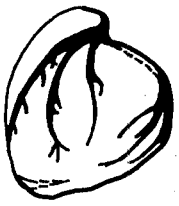
FIG. 4B shows an image (lateral mode image) taken with the positioning shown in FIG. 4A.
Figure 5A:
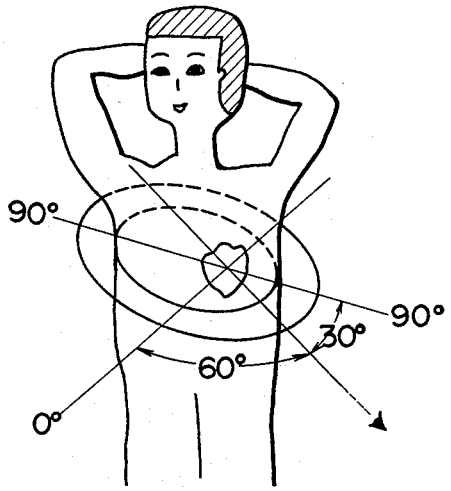
FIG. 5A shows a positioning when the object is rotated about the body axis by 60° from the direction shown in FIG. 1A.
Figure 5B:
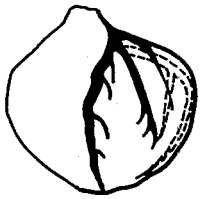
FIG. 5B shows an image (60° lateral anterior oblique mode image) taken with the positioning shown in FIG. 5A.
Figure 6A:
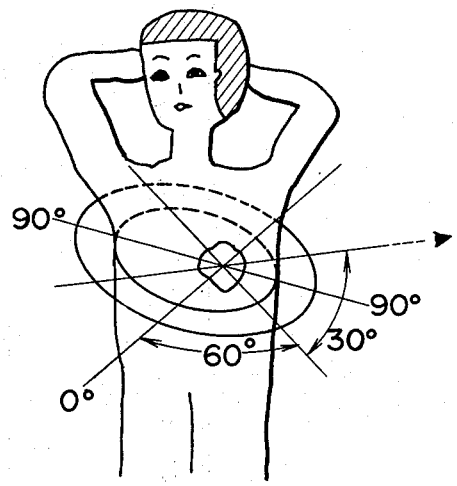
FIG. 6A shows a positioning when the object is viewed in a direction which is raised by 30° from the direction shown in FIG. 5A.
Figure 6B:
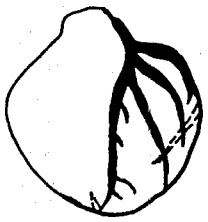
FIG. 6B is an image (60° lateral anterior oblique and 30° cranical mode image) radiographed with the positioning of FIG. 6A.
Figure 7:
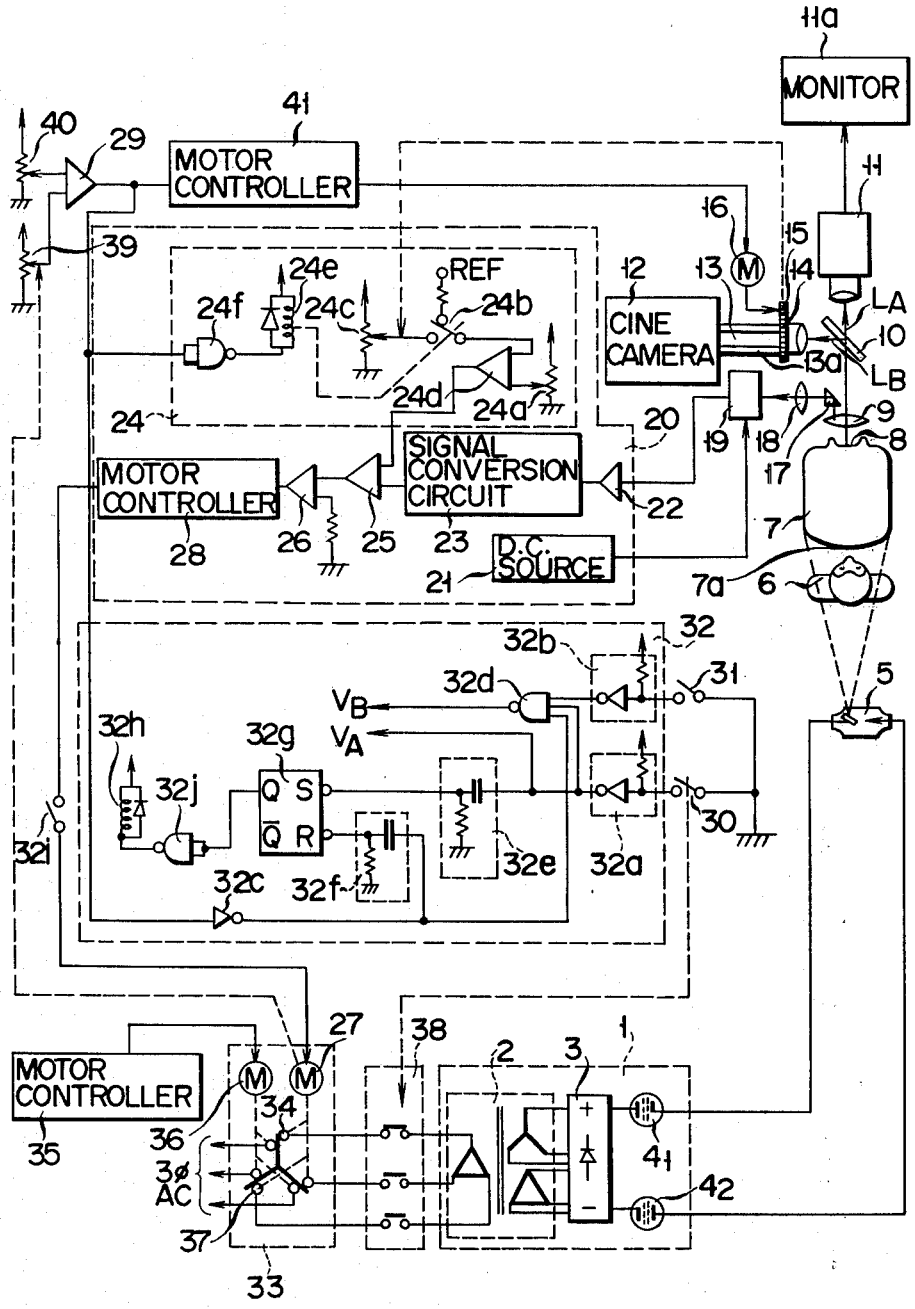
FIG. 7 is a circuit diagram of an embodiment of an X-ray cine radiography apparatus according to the present invention.

Referring to FIG. 7, there is a circuit arrangement of an embodiment of an X-ray cine radiography apparatus according to the present invention.

As illustrated on the lower part of the drawing of FIG. 7, a high voltage generation device 1 includes a high voltage generating transformer 2 for boosting a three-phase AC voltage, a high voltage rectifier circuit 3 for rectifying the output voltage from the high voltage generating transformer 2, and high voltage switching tetrodes $4_1$ and $4_2$. The high voltage generation device 1 is coupled with an X-ray tube 5 for applying a high voltage to the X-ray tube 5. The X-ray tube energized by the high voltage generation device 1 radiates X-ray toward an object such as a heart of a human body 6. The X-ray transmitted through the object is received by a fluorescent surface 7*a* on the input side of an image intensifier 7 where it is converted into a visual image. The visual image is displayed on a fluorescent plane 8 at the output of the image intensifier 7. The light rays of the image are converted into parallel rays through a convex lens 9 and then is splitted into two image beams of light $L_A$ and $L_B$. The light beam $L_A$ enters a television (TV) camera 11, while the light beam $L_B$ enters a cine camera 12. The cine camera 12 is provided at the input with a cine camera lens arrangement 13 and a diaphragm mechanism 13*a*. The diaphragm mechanism 13*a* is driven so as to adjust its aperture in response to the rotation of a gear 14. The gear 14 is in mesh with a gear 15 which is driven by a reversible motor 16. A rotating speed of the gear 15 depends on that of the motor 16.

An incident light of a prism 17 provided from the convex lens 9 enters through a convex lens 18 a photomultiplier tube 19 which produces a voltage pulse signal corresponding to the intensity of the incident light. The pulse signal is applied to a tube voltage adjusting circuit 20 for automatically adjusting the tube voltage to an proper one for the cine radiography. In the tube voltage adjusting circuit 20, a DC power source 21 supplies power to the photomultiplier 19. An amplifier 22 amplifies the pulse signal of the photomultiplier 19. A signal conversion circuit 23 converts the output signal of the amplifier 22 into an intensity level (DC) signal. A brightness level setting circuit 24 sets up a brightness level for the cine radiography. A differential amplifier 25 compares the output signal of the level setting circuit 24 with that of the conversion circuit 23. A motor controller 28 receives the output signal of the amplifier 25 through a buffer amplifier 26 so as to produce a control signal for controlling an amount of rotation of a motor 27 to be described later in detail. The level setting circuit 24 includes a differential amplifier 24*d* for substracting an output voltage of a potentiometer 24*c* provided through a relay contact 24*b* from that of a potentiometer 24*a* as a reference voltage, and a NAND gate 24*f* for driving a relay coil 24*e* of a relay contact 24*b*. The NAND gate 24*f* receives the output signal from a comparator 29 to be described later to energize or deenergize the relay coil 24*e* in accordance with the level of the output signal. When the relay contact 24*b* is transferred to an upper terminal as shown, it allows a fixed reference voltage or ground potential to be applied to the amplifier 24*d*. A switch 30 for an X-ray cine radiography preparation signal generation and another switch 31 for an X-ray cine radiography signal generation respectively provide a "1" level signal in a closed condition. As shown, the switches 30 and 31 are connected at one end to a reference potential such as ground potential, while are connected at the other end to a radiography timing controller 32. In the radiography timing controller 32, a level converter 32*a* connected to the switch 30 includes a pull-up resistor and an inverter while another level converter 32*b* connected to the switch 31 includes a pull-up resistor and an inverter. An inverter 32*c* inverts the output signal of the comparator 29 in order to provide a trigger pulse to a NAND gate 32*d* and a differential circuit 32*f*. The NAND gate 32*d* receives the output signal from the comparator 29 through the inverter 32*c*, and the output signals from the inverters 32*a* and 32*b*. The differential circuit 32*f* produces a reset pulse of an R-S flip-flop circuit 32*g* by differentiating the trigger pulse while a differential circuit 32*e* produces a set pulse of the R-S flip-flop circuit 32*g* by differentiating the output signal of the level converter 32*a*. The R-S flip-flop circuit 32*g* is set at the leading edge of the output pulse of the differential circuit 32*e* and is reset at the leading edge of the output signal from the differential circuit 32*f*. A NAND gate 32*j* receives the Q output signal from the R-S flip-flop circuit 32*g* which is at a high level when the flip-flop circuit 32*g* is set, and controls the energization of the relay coil 32h. The relay coil 32h includes a relay contact 32i which connects the motor controller 28 with a motor 27 in response to the energization of the relay coil 32h.

The output signal $V_A$ of the level converter 32a and the output signal $V_B$ of the NAND gate 32d are respectively applied to an X-ray control circuit (not shown) as an X-ray cine radiography preparation signal $V_A$ and an X-ray cine radiography signal $V_B$. A three-phase slidable winding transformer 33 is further provided, which comprises the motor 27 driven in accordance with the output signal from the motor controller 28, tube voltage regulating rollers 34 driven by the motor 27, a motor 36 controlled by a motor controller 35 for regulating the power source voltage, a roller 37 for regulating the power source voltage which is driven by the motor 36. Between the transformer 33 and the boosting transformer 1, an electromagnetic switch 38 interlocked with a switch 30 for generating the X-ray cine radiography preparation signal is connected through which the output signal from the transformer 33 is supplied to the boosting transformer 1.

Output voltages of potentiometers 39 and 40 are applied to input terminals of the comparator 29, respectively. The potentiometer 39 is interlocked with the motor 27 so that the potentiometer 39 may detect a signal corresponding to an actual X-ray tube voltage. The potentiometer 40 is adjustable to set the tube voltage for upper limit one on which the cine camera 12 provides a cine radiography with a poor contrast under ordinarily operating condition, and may be set to 70 KV at the maximum in the present embodiment, though the upper limit tube voltage depends on individual cine radiographic condition. In this respect, the potentiometer 40 functions as an upper limit tube voltage setting means. The output voltages from the potentiometers 39 and 40 are compared by the comparator 29. As previously stated, the output signal from the comparator 29 is supplied to the NAND gate 32d through the inverter 32c, and is also applied to the motor controller 41. The motor controller 41 is driven in response to the output signal of the comparator 29 to drive and control the motor 16 of the lens diaphragm mechanism 13a. In the present embodiment, the motor controller 41 controls the motor 16 so that the aperture of the diaphragm may be adjusted in accordance with the output signal of the comparator 29 when the output voltage of the potentiometer 39 exceeds that of the potentiometer 40.

The operation of the X-ray radiography apparatus thus constructed will be described.

The operation of the apparatus to first be given is in the frontal or lateral projection mode, that is, when the object is radiographed with the positioning that the X-ray is projected into the object in a direction normal to the body axis and pointed from the front or one side of the human body to the rear or the other side. The object is of the usual small-size.

Firstly, the switch 30 is turned on for generating the X-ray cine radiography preparation signal. Interlocking with the switch 30, the switch 38 is closed to allow electric power to be transferred from the transformer 33 to the high voltage generating device 1. The electric power is boosted in the high voltage generating device 1 to be supplied to the X-ray tube 5. The X-ray tube 5 radiates a dosage of X-rays in response to the supplied voltage. The X-ray is projected onto the object such as a heart of a human body 6.

The X-ray transmitted through the heart is received by the fluoroscent surface 7a of the image intensifier 7 where it is converted into an optical image. The image is displayed on the fluorescent surface 8. The visualized image passes through the concave lens 9 and is split into the light beams $L_A$ and $L_B$ by the splitter 10. The light beam $L_A$ is picked up by the television camera 11 which in turn provides a T.V. signal to the monitor 11a.

The visual image from the image intensifier 7 is also transmitted through the convex lens 9 and is turned by 90° by the prism 17, and then reaches the photomultiplier tube 19 through the convex lens 18. The brightness of the visual image may be detected and converted into a corresponding electrical signal by the photomultiplier tube 19. The output signal of the photomultiplier tube 19 is supplied to the tube voltage regulating circuit 20. In the regulating circuit 20, the image signal is properly amplified by the amplifier 22 and is converted into a DC signal corresponding to the brightness level by the signal conversion circuit 23. The DC signal is then applied to one of the input terminals of the differential amplifier 25. A signal is applied from the brightness level setting circuit 24 to the other input terminal of the differential amplifier 25. The differential amplifier 25 compares the signal representing the image with the brightness level signal to produce an output signal representing a difference between them which in turn is amplified by the amplifier 26. The amplified one is inputted into the motor controller 28 for driving and controlling the motor 27.

When the switch 30 is turned on, the level converter 32a produces a signal $V_A$ of logical "1". The signal $V_A$ is applied to the differential circuit 32c where it is differentiated. The output signal of the circuit 32e is applied to the set terminal S of the flip-flop circuit 32g. The flip-flop circuit 32g is set at the leading edge of the output signal of the differential circuit 32e. When the flip-flop circuit 32g is set, the Q output signal of the flip-flop circuit 32g is applied to the input terminals of the NAND gate 32j. In response to the output signal of the NAND gate 32j, the relay-coil 32h is energized to close the relay contact 32i. During the period of the turn-on of the switch 30, the relay-contact 32i remains closed, so that the output signal from the motor controller 28 is applied to the motor 27 by way of the relay contact 32i. The motor 27 responds to the signal to rotate and drive the rollers 34 to regulate the X-ray tube voltage. In accordance with the tube voltage, the dosage of the X-ray radiation from the X-ray tube 5 varies the brightness level of the image. Through a sequence of the operations, the reference value of the potentiometer 24a is equal to the brightness level of the image. At this time, the output signal of the differential amplifier 25 diappears, so that the drive of the motor 27 stops and under this condition, the proper value of the tube voltage is set up. In this way, the proper value of the tube voltage is set up.

When the small sized object is radiographed with the positioning as viewed in a direction normal to the axis of the body, the brightness level of the image is relatively high, so that the tube voltage applied to the X-ray tube 5 is relatively low, below the set voltage of the potentiometer 40. In this case, the output level of the comparator 29 is "0" and the controller 41 does not provide a control signal for driving the motor 16.

When the output level of the comparator 29 is "0", the output of the NAND gate 24f is at "1" level. Accordingly, the relay-coil 24e is in deenergized state and the relay contact 24b is open. For this reason, only the reference signal from the potentiometer 24a is applied to the differential amplifier 24d, with the absence of the output signal of the comparator 29 delivered through the relay contact 24b.

After the proper tube voltage is set up, the switch 31 for generating the X-ray cine radiography signal is turned on while observing the image picked up by the television camera 11 on the monitor 11a. At this time, the logical sum in the NAND gate 32d of the radiography timing control circuit 32 produces the signal $V_B$ and hence an X-ray cine radiography with high contrast is taken by driving the X-ray controller (not shown).

The explanation to follow is the operation of the cine radiography apparatus when a large sized object is radiographed or the object is radiographed with the positioning directed oblique to the axis of the body.

In such a case, the brightness level of the image obtained by the image intensifier 7 is relatively low so that the X-ray tube voltage control circuit 20 raises the X-ray voltage to increase the dosage of the X-rays radiated from the X-ray tube 5. Specifically, in such a radiography, the brightness level of the optical image is lower than a reference value (the voltage value of the potentiometer 24a) provided by the brightness level setting circuit 24. The differential amplifier 25 compares the reference value with the brightness level of the image and a difference signal thereof is large. The motor controller 28 receives the signal through the buffer amplifier 26 to provide a control signal to the motor 27 by way of the relay-contact 32i. The motor 27 receives the signal to rotate the X-ray tube voltage control roller 34 in a direction to increase the X-ray tube voltage. The dosage of the X-ray radiated from the X-ray tube 5 is increased in response to the increase of the X-ray tube voltage. As a result, it makes the brightness of the visual image on the fluorescent plate 8 increased. Since the potentiometer 39 is interlocked with rotation of the motor 27, when the voltage of the potentiometer 39 exceeds that of the potentiometer 40 corresponding to the upper limit voltage value, the output level of the comparator 29 is changed from logical "0" to "1". Upon receipt of the comparator output "1", the motor controller 41 produces a control pulse signal to drive the motor 16. The rotation of the motor 16 is transferred through the gear 15 to the gear 14 for adjusting the diaphragm mechanism 13a. The gear 14 drives the diaphragm mechanism 13a to adjust its aperture.

With the drive of the gear 16, the output voltage of the potentiometer 24c is controlled to increase under the present condition. When the output of the comparator 29 is changed from logical "0" to "1", the output of the NAND gate 24f in the brightness level setting circuit 24 is at logical "0" to energize the relay coil 24e. Accordingly, the output of the potentiometer 24c is applied as the substracted signal to the differential amplifier 24d, by way of the relay contact 24b. At this time, the reference value signal from the potentiometer 24a is also applied to the differential amplifier 24d. Accordingly, the output of the brightness level setting circuit 24 is a difference between the reference voltage value of the potentiometer 24a and the voltage of the potentiometer 24c. Interlocking with the opening operation of the diaphragm, the output voltage of the brightness level setting circuit 24 becomes gradually small and hence the tube voltage also decreases. Through the sequence of the operations, the detected voltage of the potentiometer 39 is smaller than the set voltage value of the potentiometer 40, the output level of the comparator 29 is inverted to be logical "0". In turn, the output of the NAND gate 24f becomes "1" to deenergize the relay coil 24e, so that the setting circuit 24 returns to the initial condition. When the output level of the comparator 29 is "0", the motor controller 41 stops providing the motor 16 with the control signal again, so that the opening operation of the diaphragm is completed. When the output level of the comparator 29 becomes "0", the flip-flop circuit 32g is reset and the relay coil 32h is deenergized in response to the output signal of the NAND gate 32j. Therefore, the motor 27 stops rotating. At this stage, the tube voltage is set to the proper one.

Under this condition, when the switch 31 for X-ray cine radiography is turned on, the NAND gate 32d in the radiography timing control circuit 32 provides the enabling output of the signal $V_B$ so that the X-ray cine camera 12 is driven to take the X-ray cine radiograph.

In a state that the tube voltage exceeds the upper limit voltage set for taking the radiograph with high contrast, that is, that the output of the comparator 29 is at "1" level, the NAND gate 32d does not provide the enabling output even if the switch 31 is turned on for the cine radiograph. Accordingly, it is not produced until the output level of the comparator 29 is a logical "0", thereby to prevent from taking the radiograph with low contrast.

When the output of the comparator 29 changes from logical "1" to "0", the relay contact 32i is open, so that the tube voltage is prevented from exceeding the upper limit voltage in the cine radiographying operation.

By the way, the diaphragm mechanism 13a of the cine camera 12 functions such that the diaphragm is restored to the initial state with a proper opening of the aperture at the radiographing operation.

As seen from the foregoing, the X-ray cine radiography apparatus according to the invention may provide a high contrast radiograph even for a large object. The high contrast radiograph may also be taken with the X-ray projection in a direction normal to the body axis or oblique to the same.

It should be understood that the present invention is not limited to the embodiment as mentioned above but may be changed or modified properly within the scope of the present invention. The above-mentioned embodiment detects the tube voltage in a manner that the potentiometer 39 is interlocked with the tube voltage adjusting motor 27. The tube voltage, however, may be detected in a manner that a means for measuring the tube voltage is provided and the measured value is used for the diaphragm mechanism. In the embodiment, the operation of the tube voltage adjusting circuit 20 is controlled by interlocking the operation of the diaphragm with the brightness level setting circuit 24. The same operation may be secured by varying the output of the DC power source 21 for the photomultiplier tube 19 interlocking with the diaphragm operation. The tube voltage may be detected in a manner that the output voltage of the transformer 33 is detected by the insulation transformer, not the potentiometer 39, and the detected signal is converted into a DC signal. An electromagnetic solenoide, for example, may be used in place of the motor 16, for driving the diaphragm mechanism 13a.

What is claimed is:

1. An X-ray cine radiography apparatus comprising:

X-ray tube means for radiating X-rays toward an object under examination;

means for converting the X-rays transmitted through the object into a visual image;

cine camera means for picking up the visual image;

photoelectric converting means for detecting a brightness of the visual image to produce an electric signal;

means for setting an upper limit tube voltage of said X-ray tube means;

means for detecting a signal corresponding to an actual tube voltage of said X-ray tube means;

means for comparing the output signal of said tube voltage detecting means with that of said setting means and for producing an enabling signal when the former recited output signal exceeds the latter recited output signal;

means for controlling quantity of light of the visual image picked up by said cine camera means in accordance with the enabling signal of said comparing means, and means for adjusting the actual tube voltage in response to the output signal of said controlling means and the electric signal of said photoelectric converting means.

2. An X-ray cine radiography apparatus according to claim 1, wherein said tube voltage detecting means is a potentiometer interlocked with said actual tube voltage adjusting means.

3. An X-ray cine radiography apparatus according to claim 1, wherein said controlling means comprises motor means for driving a lens diaphragm mechanism of said cine camera means and a controller for controlling the operation of said motor means in response to an output signal of said comparing means.

* * * * *